United States Patent [19]

Laszlo

[11] 3,934,880

[45] Jan. 27, 1976

[54] PLAYING SURFACE STRUCTURE FOR SPINNING TOP PIN GAMES

[76] Inventor: Lajos George Laszlo, 189 Newton Drive, Willowdale, Ontario, Canada

[22] Filed: Nov. 18, 1974

[21] Appl. No.: 524,487

[52] U.S. Cl. ..... 273/108

[51] Int. Cl.[2] ..... A63F 9/16

[58] Field of Search..... 273/108, 109, 110, 118 R, 273/119 R, 120 R, 120 A, 119 A

[56] References Cited

UNITED STATES PATENTS

| | | | |
|---|---|---|---|
| 197,091 | 11/1877 | Brown | 273/108 |
| 3,178,184 | 4/1965 | Glassman | 273/108 |

FOREIGN PATENTS OR APPLICATIONS

| | | | |
|---|---|---|---|
| 498,939 | 1/1939 | United Kingdom | 273/108 |
| 491,271 | 3/1953 | Canada | 273/118 R |
| 275,833 | 9/1951 | Switzerland | 273/118 R |
| 812,528 | 7/1951 | Germany | 273/108 |

*Primary Examiner*—Anton O. Oechsle
*Assistant Examiner*—Harry G. Strappello
*Attorney, Agent, or Firm*—J. Richard Cavanagh

[57] ABSTRACT

The specification describes a playing surface structure for spinning top pin games in which the playing surface is adjustable to a diagonal predetermined slope by the incorporation of a level indicating device fixed at a predetermined diagonal slope relative to the playing surface to enable the development of skill.

3 Claims, 7 Drawing Figures

PLAYING SURFACE STRUCTURE FOR SPINNING TOP PIN GAMES

BACKGROUND OF THE INVENTION

The invention relates to an improved playing surface and associated structure for a pin game in which a manually spinnable top member is used as a pin striking member.

In prior types of game apparatus of this general type it has been necessary to cause the playing surface to be sloped downwardly in a direction towards the array of pins to be struck by the spinning top when the latter is set in motion by the player. The development of skill at the game however, is reduced at best because on each new set up of the game by some sort of tilt supporting of the playing surface, such tilt is not consistant even though the ends of the playing surface may be supported such as by legs of predetermined different heights because the table or floor surface upon which such legs stand may not in itself be level. Furthermore, a surface which is tilted downwardly directly toward the pins i.e. in an axis direction extending from one end of the playing surface to the other through the centre of the array of pins, tends to draw the playing piece, or spinning top toward the pins thereby tending to direct the spinning top toward the centre line of the group of pins. Thus the element of skill because of the consistant conditions of slope direction and the inconsistant direction of the degree of slope is of a low order, success relying mainly upon chance where the odds are highly in favour of the player. Prior structures thus provide a game of chance, not a game of skill.

FIELD OF THE INVENTION

It is one of the objects of the present invention to provide a playing surface structure for a spinning top pin game in which a rebound peripheral playing surface structure serves as a boundary for the playing surface and support structure is provided for the latter enabling the operator to adjust the slope of the playing surface in a diagonal direction downwardly toward the pins in such manner that a levelling device incorporated in said structure enables the same precise angle of slope to be achieved for each game set up, thus to reproduce the conditions of the playing surfaces to provide a game of skill.

It is a further aim of the invention to provide a diagonally tiltable playing surface structure for a spinning top pin game adapted to be set at a predetermined angle of downward slope making possible the predictable playing of rebound shots of the spinning top from side wall rebound cushion surfaces or members defining the perimeter of the playing surface.

BRIEF DESCRIPTION OF THE DRAWINGS

The invention will be understood in more detail by reference to the following specification taken in conjunction with the drawings wherein.

DETAILED DESCRIPTION OF THE INVENTION

Figure 5:
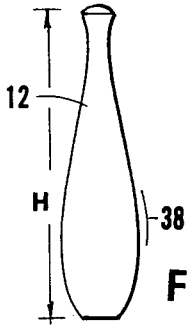
FIG. 5 is an elevation of a typical pin member utilized in association with the playing surface of FIG. 1.
Figure 7:
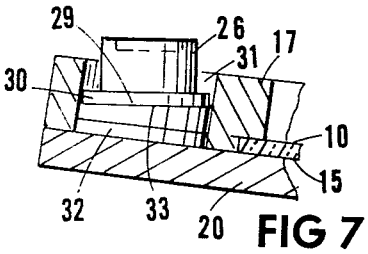
FIG. 7 is a sectional elevation on the line 7—7 of FIG. 1 showing the installation of the levelling device of FIG. 6 in the playing surface structure of the invention.

The invention is of utility in relation to a spinning top pin game in which a rectangular playing surface 10 carries a number of indicia 11 at one end thereof adapted to identify locations for standing the upsettable pins 12 (FIG. 5) whereas at the other end of the surface 10 a series of starting indicia 13 define starting points from which a spinning top structure 14 may be directed by the operator.

The spinning top 14 on a truly level surface will not travel toward the pins at indicia 11 unless the player introduces a throwing component into the spinning action. As a result in such games there is a tendency to cause a tilt of the surface 10 downwardly toward the pins on the indicia 11. This condition is not reproducible in different game set ups. Thus the development of a trained skill is not possible.

Figure 1:
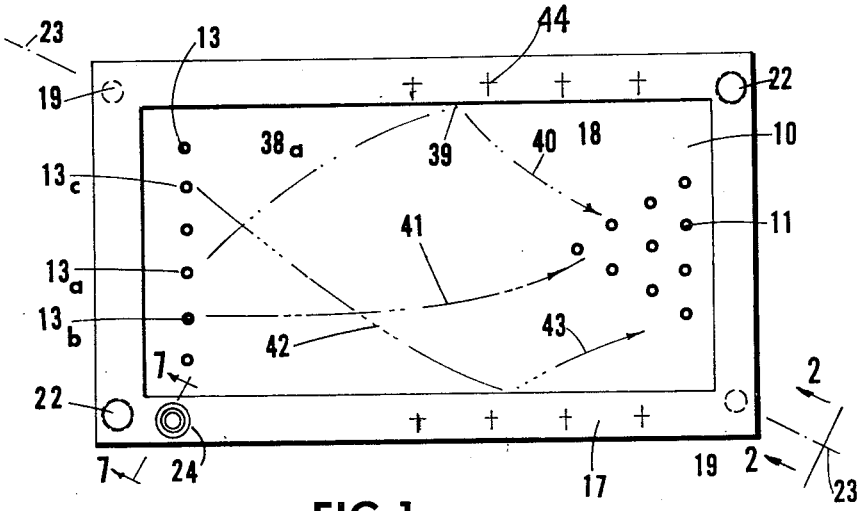
FIG. 1 is a plan view of the spinning top pin game playing surface structure of the invention.
Figure 2:
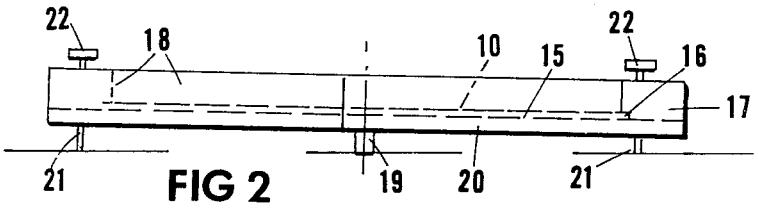
FIG. 2 is a side elevation in the direction 2—2 of FIG. 1 revealing the manner of accomplishing a diagonal slope according to the invention.
Figure 3:
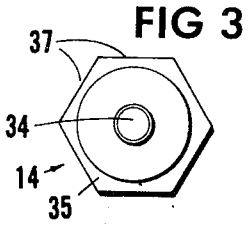
FIG. 3 is a plan view of a typical top spinning member for use with the playing surface structure of the invention.
Figure 4:
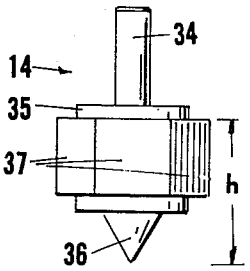
FIG. 4 is a side elevation of FIG. 3.
Figure 6:
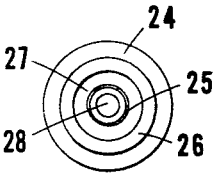
FIG. 6 is a plan view of a typical form of levelling device.

According to the invention the playing surface 10 comprises for example, a sheet of glass 15 set in peripheral recesses 16 of the upper frame portion 17, the latter having upstanding inner side walls or rebound cushion surfaces 18 defining the exposed perimeter of the playing surface 10 and of a height above said surface 10 at least equal to the actuating height *h* to be described of the spinning top member 14 of FIGS. 3 and 4. Two diagonally opposite legs 19 extend an equal distance downwardly from base member 20 supporting glass 15 and frame 17. At the other pair of diagonally opposite corners of the frame 17 and in said frame are provided adjustable legs 21 comprising screw threaded shafts extending through said frame to present a knurled knob 22 adapted for turning the screw threaded shaft in the frame to define a predetermined angle "A" describing a diagonal slope for the playing surface at right angles to the diagonal line 23 extending between the fixed legs 19.

Such predetermined angle A is defined by a conventional centre bubble levelling device 24 having a viewing glass 25 in its case 26 with a centre indicia ring 27 within which a liquid bubble 28 must be centred at which point of adjustment the undersurface 29 of its base 30 is truly horizontal or level. Thus, the bore 31 drilled in frame element 17 has cemented therein the wedge shaped support washer 32 of an included angle A between its upper and lower surfaces and a line so that a theoretical line between its minimum thickness and maximum thickness when positioned in said frame is substantially at right angles to the diagonal line 23. Upper surface 33 of washer 32 has base 30 cemented thereto by any suitable glue or cement. Thus, the adjustable legs 22 are adjusted until the bubble 28 finds its centre within the ring 27 at which point the playing surface will be set at a predetermined angle A of its plane relative to the horizontal and in the same orientation relative to the pins on the plane at each recurring set up of play after the levelling procedure described has been accomplished.

The spinning top member may be in various forms but is preferably in the form shown in FIGS. 3 and 4 wherein grippable shaft member 34 extends axially upwardly from body portion 35 rising from the downwardly tapered conically formed tip 36 upon which the spinning top member is spun on playing surface 10. Pin striking or actuating surfaces 37 may conveniently be in the form of surfaces defining a hexigon about the body portion 35 and adapted relative to the height "H" of pins 12 to strike the latter in a zone 38 containing the centre of gravity of the pin and within the actuating or striking height *h* of the spinning top member 14.

In operation the diagonal downward tilt of the playing surface structure of the invention including rebound surfaces 18 enable the spinning top pin game to be played by the development of rebound techniques in skill gaining practice. Assuming for example clockwise rotation of the top spin element 14 from starting indicia 13*a* one may easily learn the technique of control to achieve a path 38 for rebound as at 39 counter to the direction of rotation to develope an inverse curve of travel 40 toward the array of pins on indicia 11. Also, if desired, a path without rebound may be for example, accomplished from say indicia 13*b* again at clockwise rotation with an initial aim to the right of indicia 11 but in which the slope develops an inverse curve 41, which curve is reproducable at a predetermined slope. Thus a curve shot can be achieved without the operator being reduced to any determined throwing action. Further, by way of example, the player may start from say starting indicia 13*c* with an initial path far to the right of the pin indicia 11 i.e. substantially level or parallel to the axis 23 but wherein the slope causes a path of inverse curvature 42 resulting in the convex curvature of rebound 43.

To additionally assist the skill gaining ability of the player equally spaced aiming markings 44 may be provided for assistance to the player in developing precise skill.

What I claim is:

1. A playing surface structure for a spinning top pin game, the combination therewith of: rebound walls defining a rectangular perimeter for the playing surface, the latter being in the form of a flat sheet of rigid material the upper surface of which constitutes a playing surface having indicia thereon to define locations at which pins may be set up thereon; means fastening the playing surface member to said rebound wall members; a leg of fixed predetermined length at each corner of one pair of opposed diagonal corners of the rectangular playing surface and extending below said playing surface member to support the latter diagonally about the bottom ends of said legs; a level indicating device supported in one of said wall members at a predetermined gradient relative to the plane of the playing surface, the direction of said gradient being substantially at right angles to the diagonal between one pair of opposed corners; and an adjustable leg at each of the other corners of said side wall members extending therebelow for adjustment of the gradient of the playing surface to a predetermined value at which the levelling device indicates a level condition for said device.

2. The combination of claim 1 and rebound indicia on said side wall members.

3. The combination of claim 1 and a sloped washer supporting said levelling device in said one of said wall members.

* * * * *